US009194129B2

(12) United States Patent
O'Donnell

(10) Patent No.: US 9,194,129 B2
(45) Date of Patent: Nov. 24, 2015

(54) SAFETY ROOF ANCHORS

(71) Applicant: John Vincent O'Donnell, Dubbo (AU)

(72) Inventor: John Vincent O'Donnell, Dubbo (AU)

( * ) Notice: Subject to any disclaimer, the term of this patent is extended or adjusted under 35 U.S.C. 154(b) by 0 days.

(21) Appl. No.: 13/940,040

(22) Filed: Jul. 11, 2013

(65) Prior Publication Data

US 2014/0182218 A1 Jul. 3, 2014

Related U.S. Application Data

(62) Division of application No. 12/897,631, filed on Oct. 4, 2010, now Pat. No. 8,511,036.

(51) Int. Cl.

| | |
|---|---|
| ***E04D 13/00*** | (2006.01) |
| ***E04D 13/12*** | (2006.01) |
| ***E04G 21/32*** | (2006.01) |
| ***E04G 5/04*** | (2006.01) |

(52) U.S. Cl.

CPC ..... *E04D 13/12* (2013.01); *E04G 5/041* (2013.01); *E04G 5/043* (2013.01); *E04G 21/3276* (2013.01); *E04G 21/3285* (2013.01)

(58) Field of Classification Search

CPC ..... E04D 13/12; E04G 21/3285; E04G 5/041; E04G 21/3276; E04G 5/043

USPC ..... 52/57, 745.21, 11, 12, 712, 715, 698, 52/704, 708, 710, 520, 543, 92.2, 93.2; 182/3, 45, 36; 248/48.1, 48.2, 237; 108/107

See application file for complete search history.

(56) References Cited

U.S. PATENT DOCUMENTS

| | | | | |
|---|---|---|---|---|
| 1,977,663 | A | 4/1935 | Usinger | |
| 2,144,663 | A | 1/1939 | Petersen | |
| 2,424,410 | A * | 7/1947 | Miles | 52/537 |
| 2,536,704 | A | 1/1951 | Shea et al. | |
| 2,710,159 | A | 6/1955 | Gordon | |
| 2,879,961 | A | 3/1959 | Bertram | |
| 3,606,226 | A | 9/1971 | Bell, Sr. | |
| 4,249,713 | A * | 2/1981 | Glynn et al. | 248/237 |
| 4,432,518 | A | 2/1984 | Navarre | |
| 4,580,661 | A | 4/1986 | Thomson, Jr. | |
| 4,823,912 | A | 4/1989 | Gould et al. | |
| 5,058,358 | A | 10/1991 | Stratton | |
| 5,248,021 | A * | 9/1993 | Nichols | 182/3 |
| 5,358,071 | A * | 10/1994 | Stennett | 182/214 |
| 5,553,685 | A * | 9/1996 | Cook | 182/45 |

(Continued)

FOREIGN PATENT DOCUMENTS

| | | | | |
|---|---|---|---|---|
| DE | 3829384 | | 3/1990 | |
| FR | 2571078 | A1 * | 4/1986 | E04D 3/365 |

(Continued)

*Primary Examiner* — Robert Canfield
*Assistant Examiner* — Babajide Demuren

(57) ABSTRACT

This invention relates to safety anchors for roof workers and in particular to a gutter ladder anchor, a ridge anchor, a rafter anchor, and a truss anchor. In a one aspect the invention is a gutter ladder anchor formed from a metal plate, and comprising a flat base, having left, right, rear, and front ends; a fold at the front end of the base; one or more legs extending from the fold; a flange at the end of each leg, folded upwards; one or more holes located in each leg for mounting a vertical eye or a ladder location attachment; a first pattern of spaced apart holes through the base for fixing the anchor to a batten or purlin, said first pattern extending from the left end to the right end; and one or more holes through the flange of each leg for fixing the anchor to a gutter.

13 Claims, 25 Drawing Sheets

(56) References Cited

U.S. PATENT DOCUMENTS

| | | | | |
|---|---|---|---|---|
| 5,649,403 | A * | 7/1997 | Haisch | 52/693 |
| 5,727,646 | A * | 3/1998 | Gray | 182/45 |
| 5,896,719 | A * | 4/1999 | Thornton | 52/698 |
| 6,029,774 | A * | 2/2000 | Cothern | 182/107 |
| 6,209,826 | B1 | 4/2001 | Pratt, Jr. | |
| 6,354,401 | B2 * | 3/2002 | Murray | 182/214 |
| 6,722,469 | B1 * | 4/2004 | Weger, Jr. | 182/107 |
| 6,837,019 | B2 | 1/2005 | Collie | |
| 7,278,239 | B1 | 10/2007 | West | |
| 7,861,980 | B1 | 1/2011 | Verbrugge et al. | |
| 8,028,474 | B2 | 10/2011 | Beck et al. | |
| 8,028,477 | B2 | 10/2011 | Crookston | |
| 2001/0034994 | A1 | 11/2001 | Thompson | |
| 2003/0042377 | A1 | 3/2003 | Macri | |
| 2003/0046876 | A1 | 3/2003 | Higginbotham | |
| 2005/0210758 | A1 | 9/2005 | Iannelli | |
| 2007/0007503 | A1 | 1/2007 | Martinez et al. | |
| 2007/0204521 | A1 | 9/2007 | Jackson et al. | |
| 2012/0023835 | A1 | 2/2012 | Stearns et al. | |
| 2013/0206940 | A1 * | 8/2013 | Hopkins et al. | 248/237 |

FOREIGN PATENT DOCUMENTS

| | | |
|---|---|---|
| GB | 2 251 020 | 6/1992 |
| JP | 405202588 | 8/1993 |

* cited by examiner

SAFETY ROOF ANCHORS

CROSS REFERENCE TO RELATED APPLICATION

This application is a divisional of application Ser. No. 12/897,631, filed Oct. 4, 2010 for Safety Roof Anchors, now U.S. Pat. No. 8,511,036.

TECHNICAL FIELD

This invention relates to safety anchors for roof workers and in particular to a gutter ladder anchor, a ridge anchor, a rafter anchor, and a truss anchor.

BACKGROUND ART

Occupational safety is a major concern when work is conducted on a roof. Due to the risk of severe injury or death from falling from great heights, precautions have to be taken to protect workers working on roofs. One of the most common safety features for roof workers are ropes and harnesses. The workers wear the harnesses and use the rope to secure the harness to the roof. In case the worker falls from the roof, the rope prevents the worker from hitting the ground. 'Fall arrest blocks' allow the worker to retrieve more rope when slowly pulled from the block but arrest a sudden fall. The fall arrest block is fixed to the roof. Alternatively, the rope may be fixed to the roof directly without the use of a fall arrest block. Roof anchors are provided for attaching the rope or fall arrest block to the roof.

SUMMARY

Gutter Ladder Anchor

In a first aspect the invention is a gutter ladder anchor formed from a metal plate, and comprising

- a flat base, having left, right, rear, and front ends;
- a fold at the front end of the base;
- one or more legs extending from the fold;
- a flange at the end of each leg, folded upwards;
- one or more holes located in each leg;
- a first pattern of spaced apart holes through the base for fixing the anchor to a batten or purlin, said first pattern extending from the left end to the right end; and
- one or more holes through the flange of each leg for fixing the anchor to a gutter.

The fold may comprise four folding lines so as to form a bridge between the one or more legs and the base.

The fold may comprise two folding lines so as to form a step up from the one or more legs to the base.

The base may be T-shaped having a stem pointing backwards.

Four holes may be located in the stem for receiving bolts to fix the gutter ladder anchor to a U-shaped saddle bracket straddling a rafter from the bottom.

A second pattern of holes may extend along the stem for fixing the gutter ladder anchor to a rafter.

The base may comprise two fins folded downwards for straddling a rafter.

The two fins may have one hole each, aligned with each other, for receiving a bolt threaded through a rafter.

An I-nut or I-bolt may be mounted through the holes in the legs or flanges.

A ladder locator bracket may be fixed to the legs of the anchor by fasteners threaded through the holes in the legs and in the ladder locator bracket.

Ridge Anchor

In a second aspect the invention is a one piece ridge anchor comprising,

- a rectangular metal plate folded into a U-shape, having an open end, a first leg and a second leg,
- an extension of the first leg at the open end having a hole for securing a worker;
- a first pattern of spaced apart holes through the first leg, said first pattern extending proximal to the open end and parallel to the open end;
- a second pattern of spaced apart holes through the first leg, said second pattern extending distal to the open end and parallel to the open end; and
- a third pattern of spaced apart holes through the second leg of the plate, said third pattern being aligned with the holes of the first pattern;

Rafter Anchor

In a third aspect the invention is a one piece rafter anchor comprising

- a flat rectangular metal plate, having a top end;
- a flange extending substantially perpendicular from the flat plate at the top end, said flange having a hole for securing a worker and a plurality of holes for attaching ribbons for locating the rafter anchor under tiles;
- a plurality of spaced apart holes through the flat plate for fixing the plate to a rafter, said holes forming a pattern extending parallel to the top end.

Truss Anchor

In a fourth aspect the invention is a truss anchor comprising

- a flat rectangular metal plate, having a front end;
- a web upwardly extending from the front end;
- an extension extending from the top of the web away from the plate, the extension having a hole for securing a worker,
- a plurality of spaced apart holes through the plate for fixing the plate to a truss, said holes forming a pattern extending parallel to the front end.

BEST MODES OF THE INVENTION

Gutter Ladder Anchor—Design One

Figure 1:
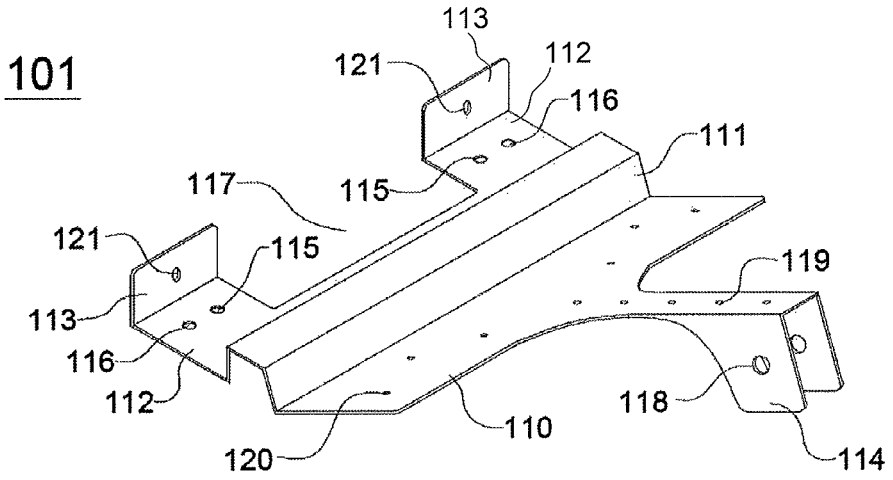
FIG. 1 illustrates a first example of a gutter ladder anchor.

FIG. 1 illustrates a first example of a gutter ladder anchor 101. The gutter ladder anchor 101 is formed of a folded metal sheet steel plate and includes a T-shaped base 110, a bridge 111 (in order to clear the fascia), two horizontal legs 112 on each side, extending from the bridge, each containing a ladder anchor hole 115 and a safety line connection point 116. An upwardly folded flange 113 is located at the front (gutter) end of each leg 113. Two downwardly folded fins 114 are located at the back of the base, each containing a bolt hole 118 for fixing the anchor to a rafter.

A pattern of rafter mounting holes 119 extends along the stem of the T-shaped base 110 near a centred line, leading away from the bridge 111.

A pattern of mounting holes 120 extends along the base 110 parallel to the bridge 111. Each flange 113 contains gutter mounting holes 121 along the flange 113. The holes can vary in size depending on the type of sheeting used for each of the anchor points.

In use, the base 110 is fixed to a rafter through rafter mounting holes 119. The base provides support for the legs 112, which in turn support the flanges 113. The gap 117 between the legs 112 allows rain water to flow freely from the roof into a gutter 106 (shown in FIG. 2).

The gutter ladder anchor 101 provides support for a ladder leaned against the gutter, an anchor point to secure the ladder against sliding or toppling, and a safety point for accessing the roof. Alternatively the gutter ladder anchor 101 may be used to support the base of the ladder to allow access to higher roofs. A worker leans a ladder against the gutter 106 at the position of the gutter ladder anchor 101. The worker climbs up the ladder. As soon as the worker can reach the rope holes 116 in one of the legs 112 of gutter ladder anchor 101, the worker secures one end of a ladder rope to the rope holes 116. The other end of the rope is attached to a harness to be worn by the worker. Alternatively the worker may attach a fall arrest block (safety line) to hole 116 and attach the harness to the lead from the fall arrest block. The worker now continues with performing work to be done on the roof. In case the worker falls from the roof, the rope or lead from the fall arrest block prevents the worker from hitting the ground. The anchor 101 provides stability against the force from the falling worker transferred to the anchor 101 via the rope or the lead.

Figure 2:
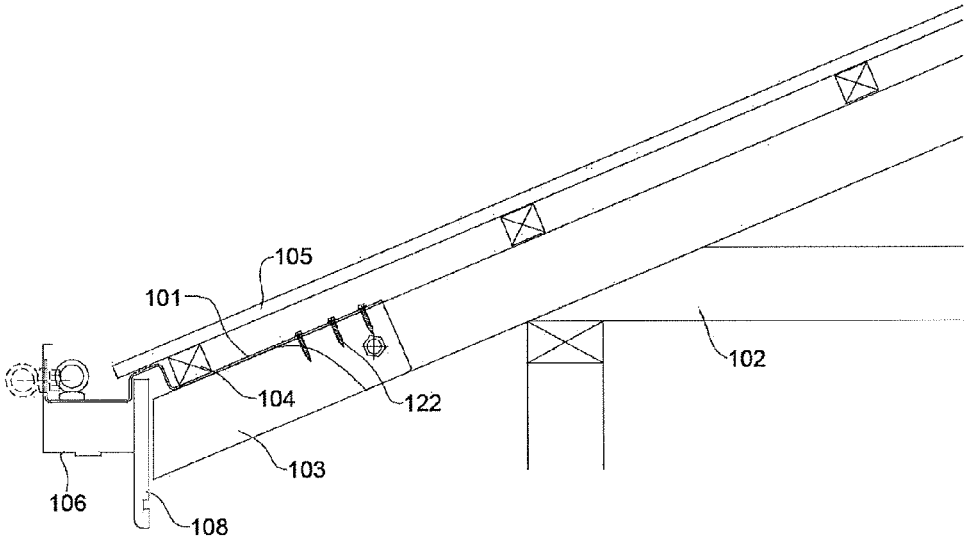
FIG. 2 shows how the gutter ladder anchor according to the first example is folded under a batten.

FIG. 2 illustrates a typical installation of a gutter ladder anchor 101. The figure shows a timber frame 102, which supports declined rafters 103. The top end of the rafters 103 meet at the ridge of the roof and the bottom end, which overhangs the frame 102, forms the eave. Battens 104 are fixed to the rafters 103 and provide support for the roof sheeting 105. A rain gutter 106 is arranged at the end of rafters 103 and a fascia 108 is located between the rain gutter 106 and the rafter 103.

Figure 3:
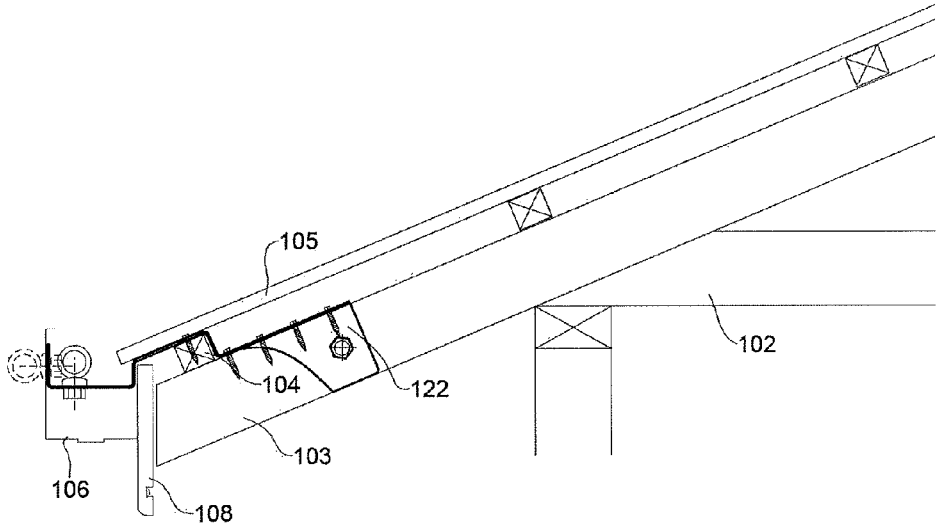
FIG. 3 shows how the gutter ladder anchor according to the first example is folded over a batten. Design 1.
Figure 4:
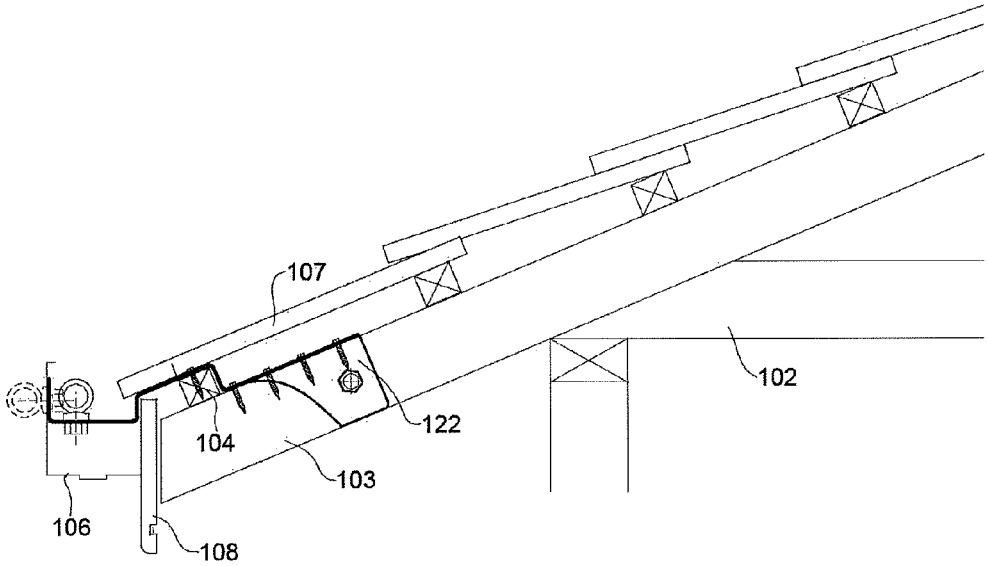
FIG. 4 illustrates another example where the roof is covered with tiles.

The anchor 101 may be folded in such a way as to fit various different applications such as depicted in FIGS. 2-4. The features of the gutter anchor 101 may also be changed to suit different applications. Such features are width, breadth, depth of flange 113, thickness of metal used, type of material, and the number and position of holes 119, 120 and 121. These modifications make the gutter anchor adjustable to varying circumstances such as relevant standards and codes, type of roof sheet (tiles or slate), type of building construction, type of flashings, or any special requirement.

FIG. 2 shows how the gutter ladder anchor 101 is mounted to a roof. The base 110 of gutter ladder anchor 101 is folded under the batten 104 and along rafter 103. The anchor 101 is secured to the rafter 103 by screws 120 through rafter mounting holes 116 (visible in FIG. 1).

In a different example of FIG. 3 the base 110 of the anchor 101 is folded over batten 104 and along rafter 103.

FIG. 4 illustrates yet another example where the roof is covered with tiles 108. In this case the base plate 110 of the gutter ladder anchor is folded over fascia 108 and batten 104 and along rafter 103.

The advantages of the gutter anchor 101 are that it can be used as an anchor point for a safety line when working on the opposite side of the roof. The gutter anchor 101 also supports the gutter when the ladder is leaned against it and secures the ladder, to prevent it from slipping. A worker may also use the gutter anchor 101 as an anchor for ladders used on top the roof (for steep roofs, a second ladder is placed on the roof to allow safe access up and down the roof), and to protect roof material form damage. The proposed gutter anchor does not hinder normal gutter functioning—an opening 117 permits normal flow of water. More than one gutter anchor may be attached to a building. For installing the gutter anchor, there is no need to get under the roof or into the ceiling cavity because the gutter anchor is installed at the time of construction prior to being needed, without any alteration to the structure itself. As a result of mounting the gutter anchor under the roof sheeting there is no need to make holes in the roof and no need to remove roof sheets. The roof sheets are simply lifted at the gutter to install the gutter anchor.

The following describes the process for installing the gutter anchor 101 in more detail. In the case of a tiled or slated roof the folded gutter anchor 101 is installed under the bottom row of tiles 107 and fastened to the gutter and rafter as shown in FIG. 4. In order to access the rafter 103, at least two tiles are removed from the bottom row where the ladder needs to be placed. The gutter anchor may comprise multiple smaller gaps 117 between multiple legs 112 instead of one single elongated gap 117. The gutter anchor 101 is then located such that these smaller gaps align with drain sections of the tiles 107. The gutter anchor 101 is then attached to the gutter by inserting gutter bolts or screws into gutter mounting holes 121 and corresponding holes in the gutter. Screws 122 are then inserted to attach the gutter anchor 101 to the rafter 103. After replacing the tiles, the gutter anchor is ready for use. The fins 114 are then bolted through hole 118 and through the timber truss chord/rafter.

The following describes the procedure if the anchor hook is to be installed by retro fitting an existing metal roof. First, the bottom rows of screws is removed from the roof sheet/bottom batten. Next, gutter hook 101 is slid under the existing roof sheet 105 and is positioned with the flange hard against inside of gutter 106. Then, existing roof sheets 105 are fastened to the batten through the gutter anchor 101 with appropriate roof screws. Optionally, the existing gutter 106 may be screwed to the flange 113 for added gutter support.

For installing the gutter anchor with a new roof, the gutter anchor is installed before sheeting the roof. Therefore, the gutter anchor is located over batten 104 and centred on the rafter 103 with flange 113 hard against the inside of the gutter. Then, the screws 122 are inserted into holes 119, screwed into rafter 103 and bolted through fin 114 and rafter 103. Finally, the roof sheets are installed as normal. As before, the flange 113 may be screwed to the gutter 106 for additional gutter support. If tiles are used instead of sheeting, the procedure is similar with the only difference that the sarking needs to be installed together with the tiles.

Gutter Ladder Anchor—Design Two

Figure 5:
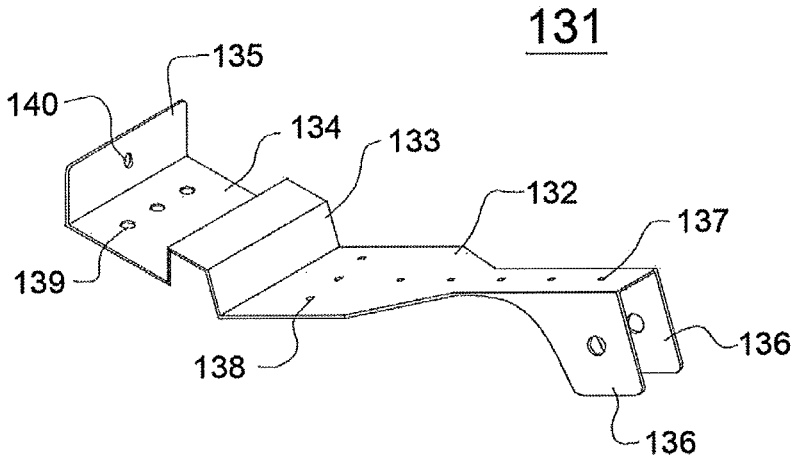
FIG. 5 illustrates a second example of a gutter ladder anchor.

FIG. 5 illustrates a second example of a gutter ladder anchor 131. The gutter ladder anchor 131 is formed of a folded metal sheet steel plate and includes a T-shaped base 132 having a short bar and a longer stem, a bridge (in order to clear the fascia), a horizontal leg 134, extending from the bridge, containing a variable number of ladder anchor holes 139. One of the holes 139 may also serve as a safety line anchor connection point. An upwardly folded flange 135 is located at the front (gutter) end of the leg. Two downwardly folded fins 136 are located at the back of the base, each containing a bolt hole 141 for fixing the anchor to a rafter 103.

A pattern of rafter mounting holes 137 extends along the stem of the T-shaped base 132 near a centred line, leading away from the bridge 133.

A pattern of mounting holes 138 extends along the base 132, parallel to the bridge 133. The holes can vary in size depending on the type of sheeting used for each of the anchor points. The vertical flange 135 contains gutter mounting holes 140 along the flange 135.

In use the base 132 is fixed to a rafter through rafter mounting holes 137. The base provides support for the leg 134, which in turn support the flange 135.

The gutter ladder anchor 131 provides support for a ladder leaned against the gutter and an anchor point to secure the ladder against sliding or toppling. And a safety point for accessing the roof. The worker climbs up the ladder. As soon as the worker can reach the tie down point in the bottom flange 139 of gutter ladder anchor 131, the worker secures one end of a ladder rope to the rope holes 139. The other end of the rope is attached to a harness to be worn by the worker. Alternatively the worker may attach a fall arrest block (safety line) to hole 139 and attach the harness to the lead from the fall arrest block. The worker now continues with performing work to be done on the roof. In case the worker falls from the roof, the rope or lead from the fall arrest block prevents the worker from hitting the ground. The anchor 131 provides stability against the force from the falling worker transferred to the anchor 131 via the rope or the lead.

When the gutter ladder anchor Design 2 is installed as stated above it can also be used as gutter reinforcement for extra gutter support in snow load conditions, by fixing the flange 135 to the back of the front face of the gutter 106. Alternatively, the gutter ladder anchor can provide support for the gutter so as to allow the gutter to be a pitching point for ancillary structures, such as shade sails and patio covers by effectively transferring load back to existing rafter 103.

Figure 6:
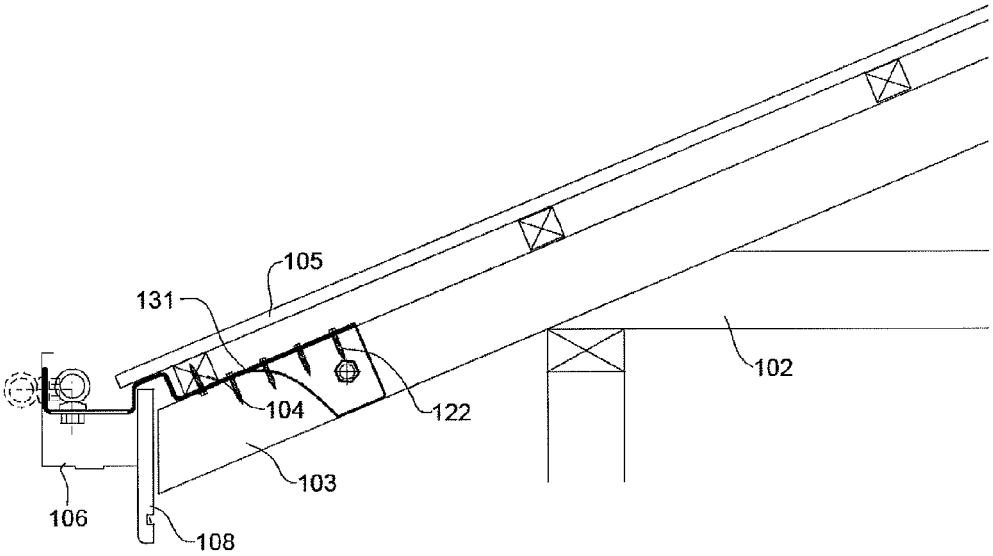
FIG. 6 shows how the gutter ladder anchor according to the second example is folded under a batten.

FIG. 6 illustrates a typical installation of a gutter ladder anchor 131. The figure shows a timber frame 102, which supports declined rafters 103. The top end of the rafters 103 meet at the ridge of the roof and the bottom end, which overhangs the frame 102, forms the eave. Battens 104 are fixed to the rafters 103 and provide support for the roof sheeting 105. A rain gutter 106 is arranged at the end of rafters 103 and a fascia 108 is located between the rain gutter 106 and the rafter 103.

The base 132 of gutter ladder anchor 131 is folded under the batten 104 and along rafter 103. The anchor 131 is secured to the rafter 103 by screws 122 through rafter mounting holes 137.

Gutter Ladder Anchor

Design 3 (for Steel Trusses Plus Option for Timber Rafters)

Figure 7:
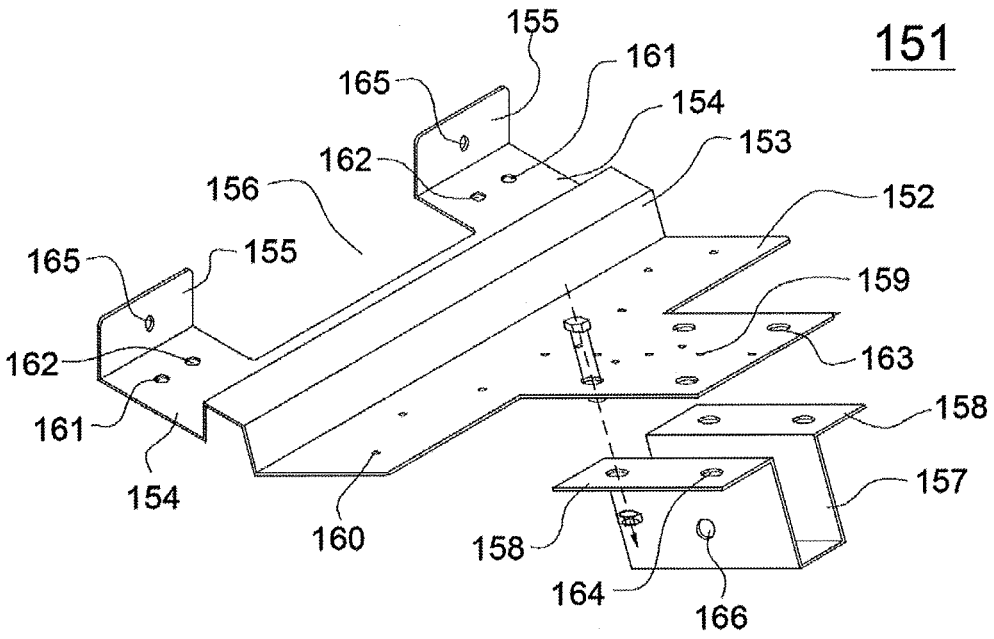
FIG. 7 shows a third example of a gutter ladder anchor.

FIG. 7 illustrates a third example of a gutter ladder anchor 151. The gutter ladder anchor 151 is formed of a folded metal sheet steel plate and includes a T-shaped base 152, a bridge 153 (in order to clear the fascia), two horizontal legs 154 on each side, extending from the bridge, each containing a ladder anchor hole 162 and a safety line connection point 161. An upwardly folded flange 155 is located at the front (gutter) end of each leg 154.

A pattern of rafter mounting holes 159 extends along the stem if the T-shaped plate 152 near a centred line, leading away from the bridge 153.

A pattern of mounting holes 160 extends along the plate 152, parallel to the bridge 153 and each flange 155 contains gutter mounting holes 165 along the flange 155. The holes can vary in size depending on the type of sheeting used for each of the anchor points.

In use the T-shaped base 152 is fixed to a rafter through rafter mounting holes 159. The base 152 provides support for the legs 154, which in turn support the flanges 155. The gap 156 between the legs 112 allows rain water to flow freely from the roof into the gutter 106 (shown in FIG. 8).

Four bolt holes 163 are located at the corners of the stem of the T-shaped base 152 for bolting the anchor to a saddle bracket 157. Saddle bracket 157 consists of a U-shaped bracket, with flanges 158 at the top of the U-shape. Each flange 158 contains 2 bolt holes 164 to be used in conjunction with and aligned to the bolt holes 163 on plate 152.

Each of the two legs of the U-shape 157 contain a bolt hole 164 to allow the unit to be bolted horizontally through the side of a timber rafter/truss chord 103.

Figure 8:
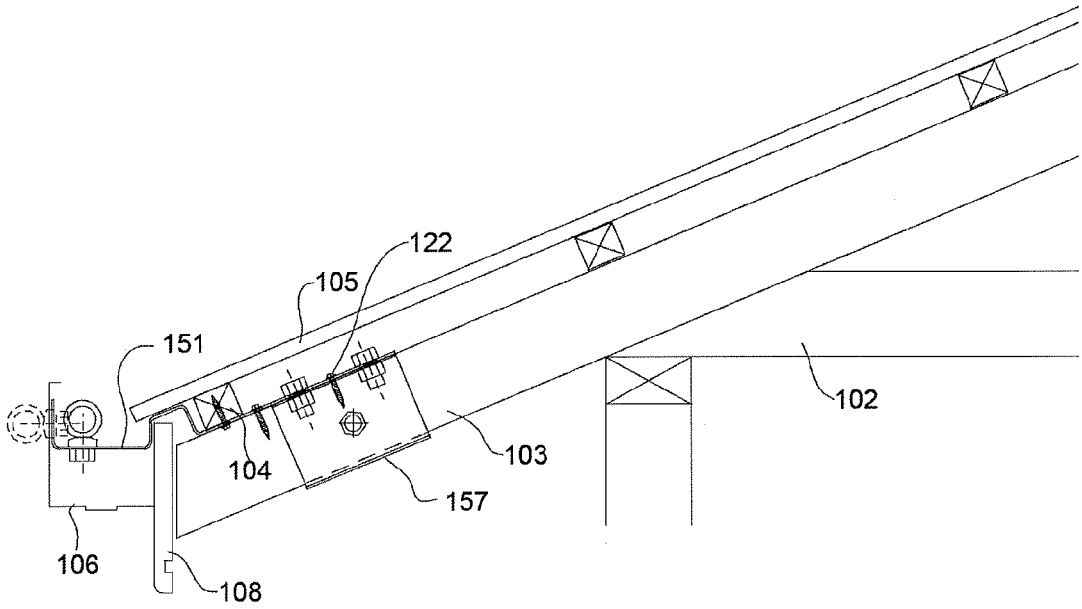
FIG. 8 shows gutter ladder anchor according to the third example installed.

FIG. 8 illustrates a typical installation of a gutter ladder anchor 151. The figure shows a timber frame 102, which supports declined rafters 103. The top end of the rafters 103 meet at the ridge of the roof and the bottom end, which overhangs the frame 102, forms the eave. Battens 104 are fixed to the rafters 103 and provide support for the roof sheeting 105. A rain gutter 106 is arranged at the end of rafters 103 and a fascia 108 is located between the rain gutter 106 and the rafter 103.

The base 152 of gutter ladder anchor 151 is folded under the batten 104 and along rafter 103. The anchor 151 is secured to the rafter 103 by screws 122 through rafter mounting holes 159 (visible in FIG. 8).

For Timber Rafters:

Saddle bracket 157 is placed around the timber rafter 103 such that it straddles the rafter 103 from underneath. Bolt holes 164 on top flange 158 are to be aligned with and bolted to holes 163 on base 152. The U-shaped bracket is connected to rafter 103 through a drilled bolt hole through timber rafter 103 and holes 166 on the U-shaped bracket 157. The saddle bracket is not required for a steel truss.

Gutter Ladder Anchor—Design 4: C-Purlin Construction

Figure 9:
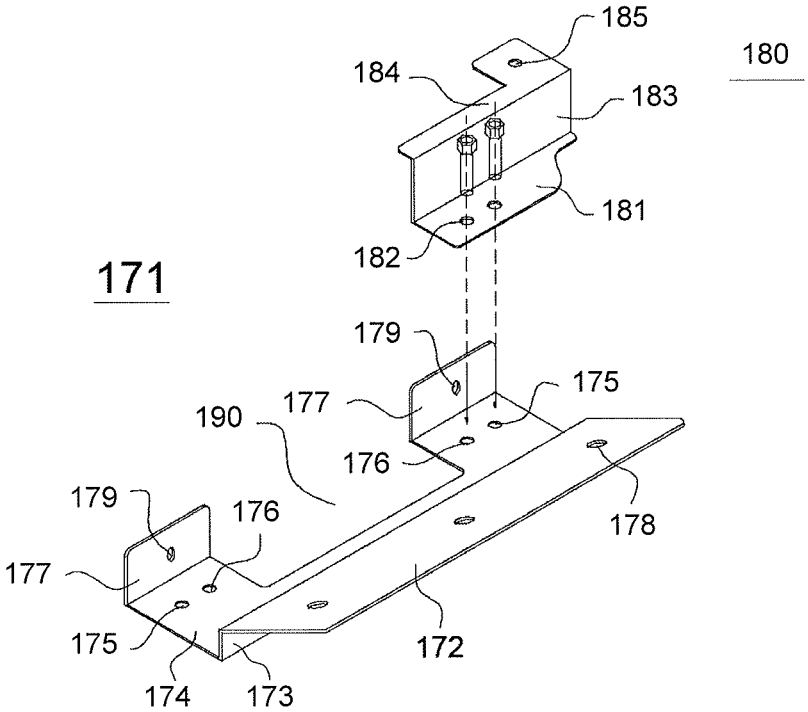
FIG. 9 shows a fourth example of a gutter ladder anchor.

FIG. 9 illustrates a fourth example of a gutter ladder anchor 171. The gutter ladder anchor 171 is formed of a folded metal sheet steel plate and includes a base 172, a step 173, two horizontal legs 174 on each side, extending from the step 173, each containing a ladder anchor hole 175 each and a safety line connection point 176.

An upwardly folded flange 177 is located at the front (gutter) end of each leg 174.

A pattern of C-Purlin mounting holes 178 extends along the base 172, from left to right and each flange 177 contains gutter mounting holes 179 along the flange 177. The holes can vary in size depending on the type of sheeting used for each of the anchor points.

In use, the base 172 is fixed to a C Purlin through mounting holes 178. The base provides support of the legs 174, which in turn support the flanges 174. The gap 190 between the legs 174 allows rain water to flow freely from the roof into the a gutter 106 (shown in FIG. 9).

Figure 10:
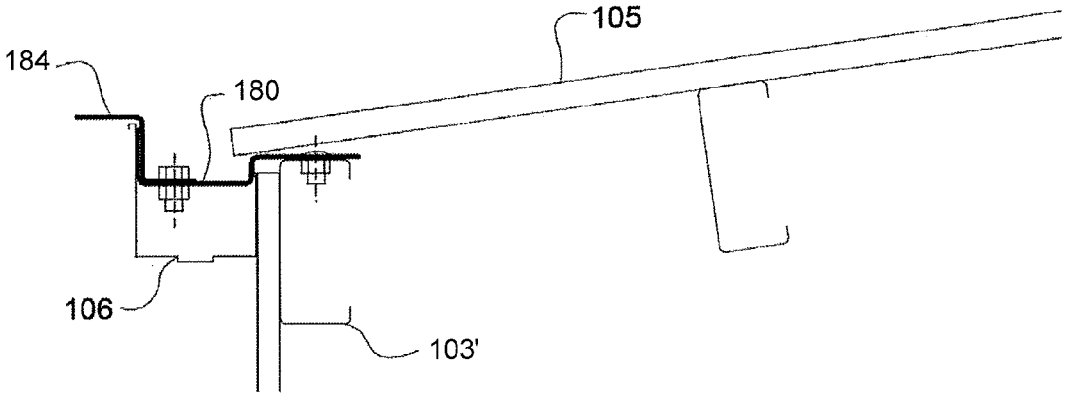
FIG. 10 shows gutter ladder anchor according to the fourth example fixed to C Purlin.

FIG. 10 illustrates a typical installation of a gutter ladder anchor 171. The figure shows a Steel C Purlin system 103*a* which forms the wall frame and supports the roof sheet 105. A rain gutter 106 is arranged at the end of rafters 103.

The base 172 of the gutter ladder anchor 171 is folded over wall sheeting and bolts directly to C Purlin, via holes 176. An 'I" bolt can be installed if needed on face of batten or on gutter ladder anchor point The following describes the process for installing gutter ladder anchor 171 in more detail. Gutter ladder anchor 171 is installed under the edge of the roof sheeting at the gutter, before roof sheeting is installed. Gutter ladder anchor 171 is attached by bolting base 172 to the fascia beam/C Purlin 103' via holes 176. Holes in the fascia beam will need to be drilled to suit and roof sheet to be installed as per normal.

Ladder Locator Bracket

Ladder locator bracket 180 in FIG. 9 is a bracket used over the gutter line to locate any given gutter ladder anchor from the ground. It has a flange protruding, which the ladder can be butted up to, to prevent the ladder slipping until it is tied down, a lip also protrudes here preventing damage & scratching to the gutter.

It consists of a 'Z' shaped folded plate, comprising a bottom flange 181 with two holes 182 to allow fixing to any gutter ladder anchor. A vertical web 183 variable in height to clear top of gutter lip and locator flange 184 with hole 185 for an optional tie down.

Installation:

The ladder locator bracket 180 is aligned and bolted to the ladder tie down and safety anchor points of any given gutter ladder anchor through holes 182 in flange 181. An optional 'I' bolt/nut can be installed.

Ridge Anchor

Figure 11:
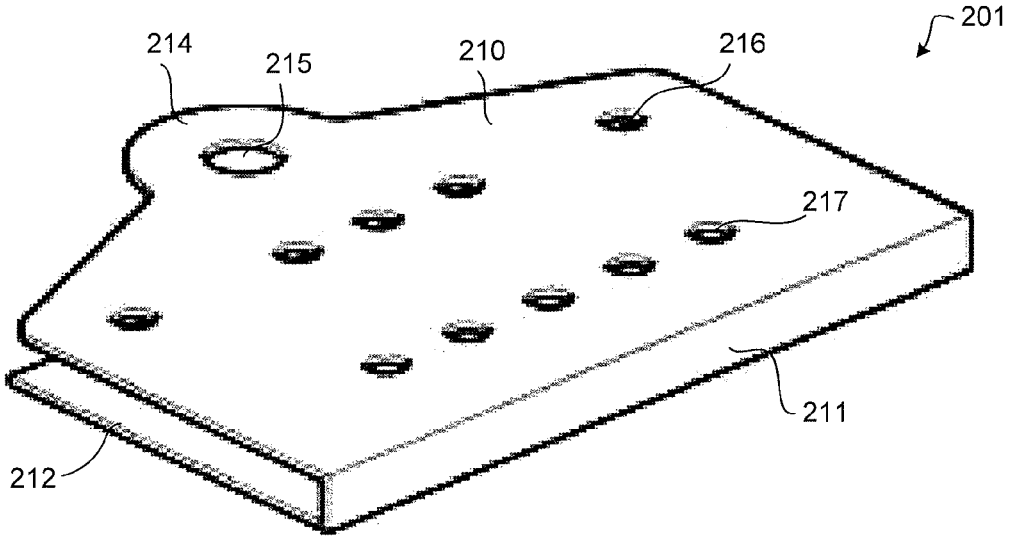
FIG. 11 illustrates a top view of a ridge anchor.

FIG. 11 illustrates a top view of a ridge anchor 201. The ridge anchor is formed of a U-shaped rectangular sheet metal plate. The U-shaped plate opens towards the front end of the ridge anchor 201 and includes an upper leg 210, a vertical web 211, and a bottom leg 212. An extension 214 protrudes forwardly from the upper leg 210 and a safety line hole 215 is centred in the extension 214. Upper batten mounting holes 216 through the upper leg 210 are arranged parallel and proximal to the open end of the anchor. Cap mounting holes 217 through the upper leg 210 are arranged parallel to and distal from the open end of the anchor.

Figure 12:
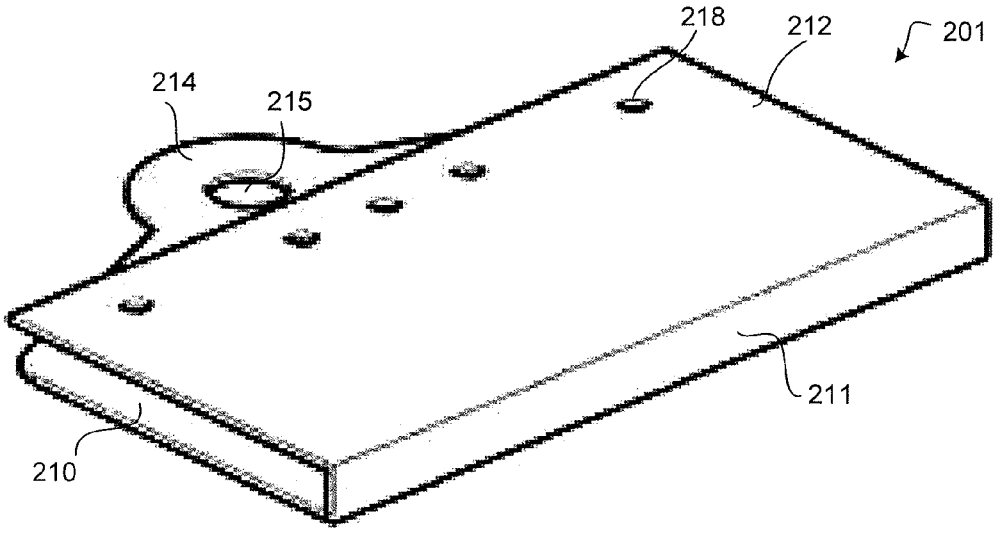
FIG. 12 illustrates a bottom view of the ridge anchor.

FIG. 12 illustrates a bottom view of the ridge anchor 201 from FIG. 11 comprising an upper leg 210, a vertical web 211, and a bottom leg 212. Bottom batten mounting holes 218 are located along a line parallel and proximal to the open end of the anchor. The bottom batten mounting holes 218 are aligned with the upper batten mounting holes in FIG. 11. Holes can vary in size depending on the type of sheeting used for each of the anchor points.

When in use, the U-shaped plate is slid over roof sheeting and fixed to a batten. It provides support for the extension 214 such that the safety line hole 215 can be used to attach a safety line.

A worker accesses the roof and attaches a safety line to the anchor and is from then on secured against falling from the roof. An optional 'I bolt/nut' can be temporarily or permanently attached to the anchor point on hole 215 for a more versatile safety line. It is advantageous to have an anchor point available that is as high on the roof as possible, because with a higher anchor point a longer safety line can be used, which results in wider movement and still prevents the worker from falling from the roof.

Figure 13:
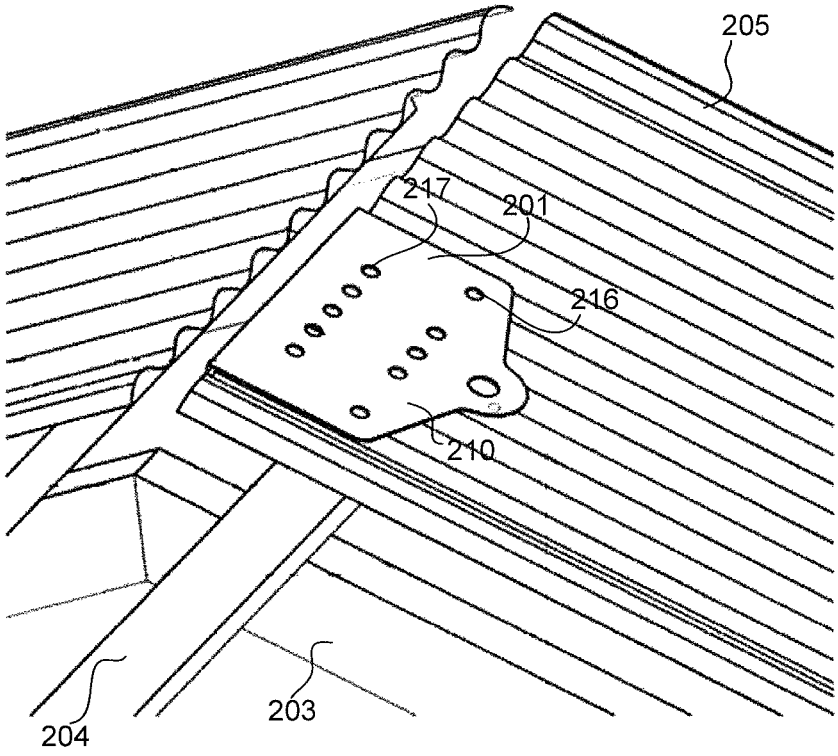
FIG. 13 illustrates a top view of a typical installation of a ridge anchor.
Figure 14:
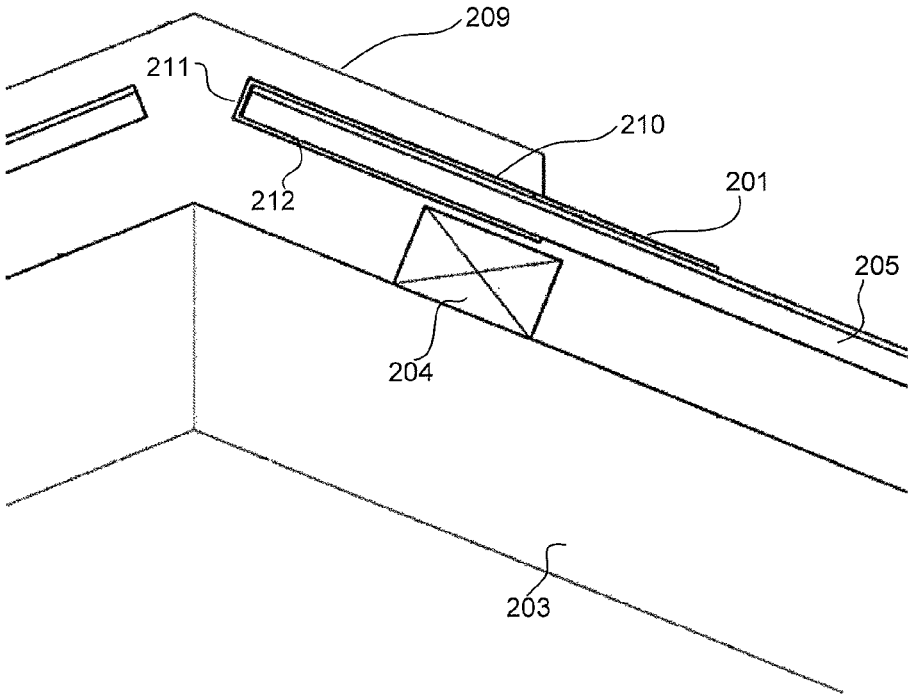
FIG. 14 illustrates a sectional view of a typical installation of a ridge anchor.

Referring now to FIGS. 13 and 14 a typical installation of ridge anchor 201 is illustrated. The anchor 201 is installed on a roof comprising a rafter 203, a batten 204, roof sheeting 205, and a ridge capping 209 (visible only in FIG. 14). The ridge anchor 201 is slid over the roof sheeting 205 such that the U-shape of the anchor 201 straddles the sheeting 205. The upper leg 210 lies on top of roof sheeting 205, and the bottom leg 212 lies between the batten 204 and the roof sheeting 205. The ridge hook 201 is sized such that the fixing holes 216 align with the batten 204 when the vertical web 211 of the anchor 201 abuts the end of the roof sheeting 205 (best seen in FIG. 14).

Figure 15:
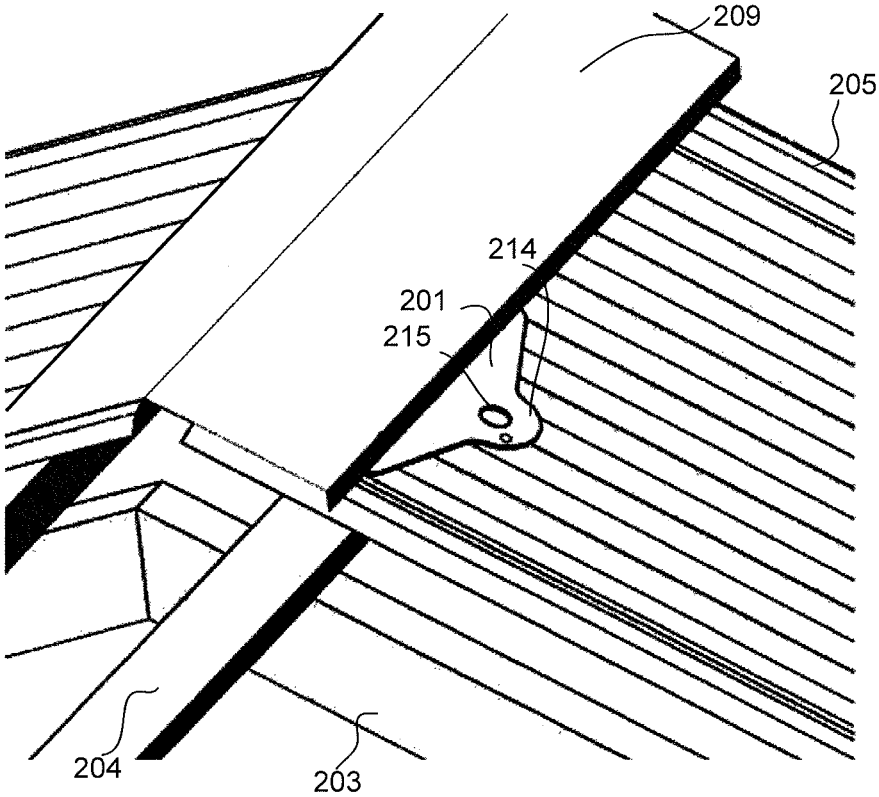
FIG. 15 illustrates an installed ridge anchor partly covered by a ridge capping.

FIG. 15 illustrates an installed ridge anchor 201 as it is installed on a roof comprising a rafter 203, a batten 204, roof sheeting 205 and a ridge capping 209. The anchor 201 straddles the roof sheeting 205 as described above and is then covered with ridge capping 209. The roof anchor is sized such that the extension 214 of anchor 201 protrudes from the ridge capping 209 and the safety line hole 215 is accessible.

Figure 16:
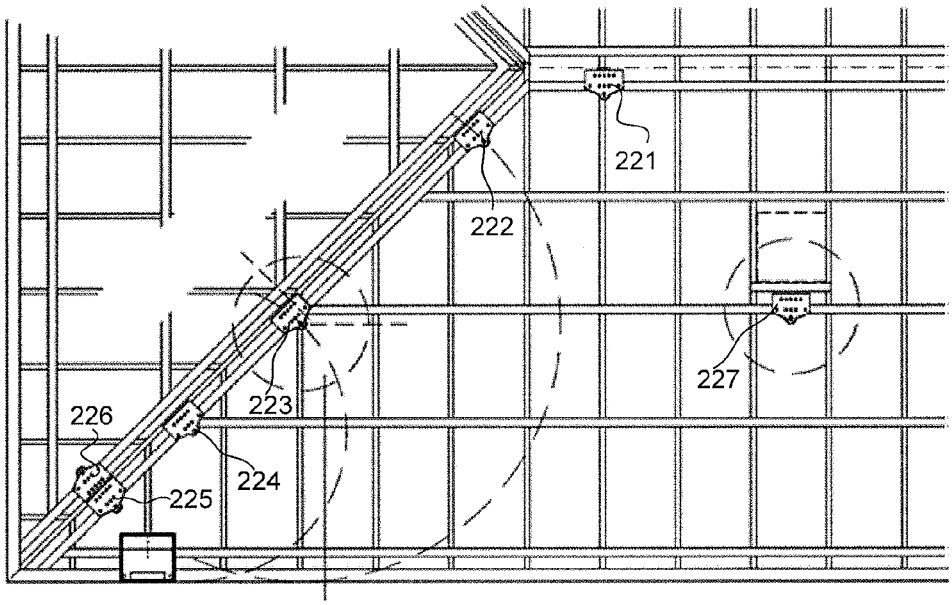
FIG. 16 illustrates various different positions for installing a ridge anchor.

FIG. 16 illustrates various different positions for installing a ridge anchor. These positions include at a ridge 221, at a hip 222-225, or at any other flashing such as 227. The Ridge hook can also be used as a temporary anchor point when attached at the gutter and working on the far side of the roof.

The benefits of the proposed ridge anchor are that there is no need to get under the roof or into the ceiling cavity to install the anchor. Further, the anchor can be installed at the time of construction or prior to being needed, without any alteration to the structure itself and it can be installed using the tools available to any roof tradesman. With using the proposed anchor there is less chance of water leakage compared to existing anchors because there is no need to make holes in the roof. For installing the roof anchor there is no need to remove the roof sheets. In the event of a fall, the energy is absorbed not only relying on screws or bolts, because the anchor is fixed to the roof structure, such as batten, top hat or purlin, the roof sheeting and the ridge flashing. As a result, the load on the roof is spread over the whole area and there is less damage to the structure.

Referring to FIGS. 13 and 14, the following outlines the steps required for installing the ridge anchor 201 on a ridge, hip, or other flashing. Once the roof sheets 205 are in position, and before the ridge capping or flashing 209 is installed. The ridge anchor is slid over the top end of roof sheets 205 with the bottom leg 212 inserted between roof sheet 205 and batten 204. A suitable screw is positioned through one of the holes 216 then screwed through the roof sheet 205, and through the bottom leg 212 of ridge anchor 201, and through to the batten below 204. Two further screws are to be positioned through 2 of the 5 holes 216 (one either side of centre of ridge anchor 201 as appropriate for roof sheet corrugates), and fastened through roof sheets 205, into bottom leg 212 of ridge anchor 201. The capping 209 is then installed as normal. Two screws are fastened through the capping 209, through the upper leg 210 of the roof anchor 201 via remaining holes 216, through the roof sheet 205, through the bottom leg 212, and into the roof batten 204. The protruding section of the roof anchor is painted to match the roofing.

An 'I' bolt/nut can be installed.

Rafter Anchor

Figure 17:
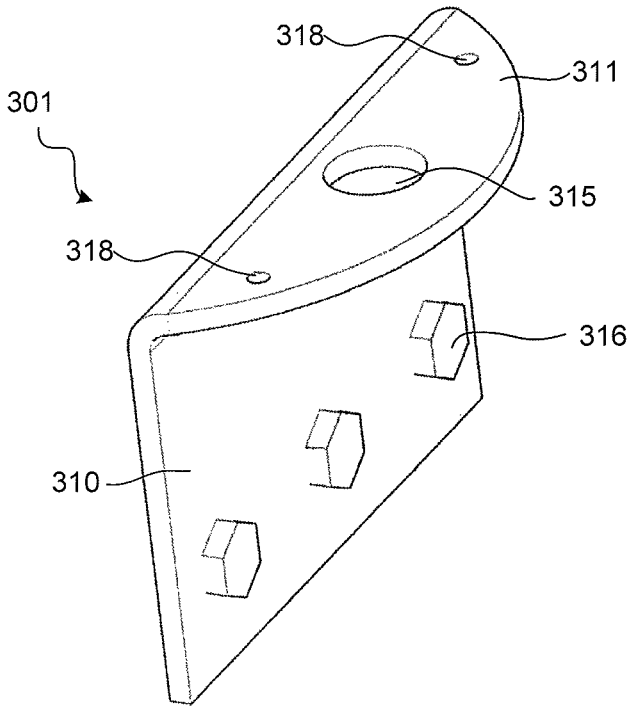
FIG. 17 illustrates a rafter anchor.

FIG. 17 illustrates a rafter anchor 301. The rafter anchor 301 is formed of a rectangular steel plate and includes a base 310 and a rounded flange 311 extending perpendicular from the top edge of the base 310. A safety line hole is centred in the rounded flange 311. Three rafter mounting holes 316 are located in the base 310 and ribbon holes 318 are located in the flange. The holes can vary in size depending on the type of sheeting used for each of the anchor points.

In use, the base 310 is fixed to a rafter using bolts inserted in mounting holes 316 and provides support for the flange 311. A safety line is attached to safety line hole 315 in the flange 311 to secure a worker from falling off the roof.

Figure 18:
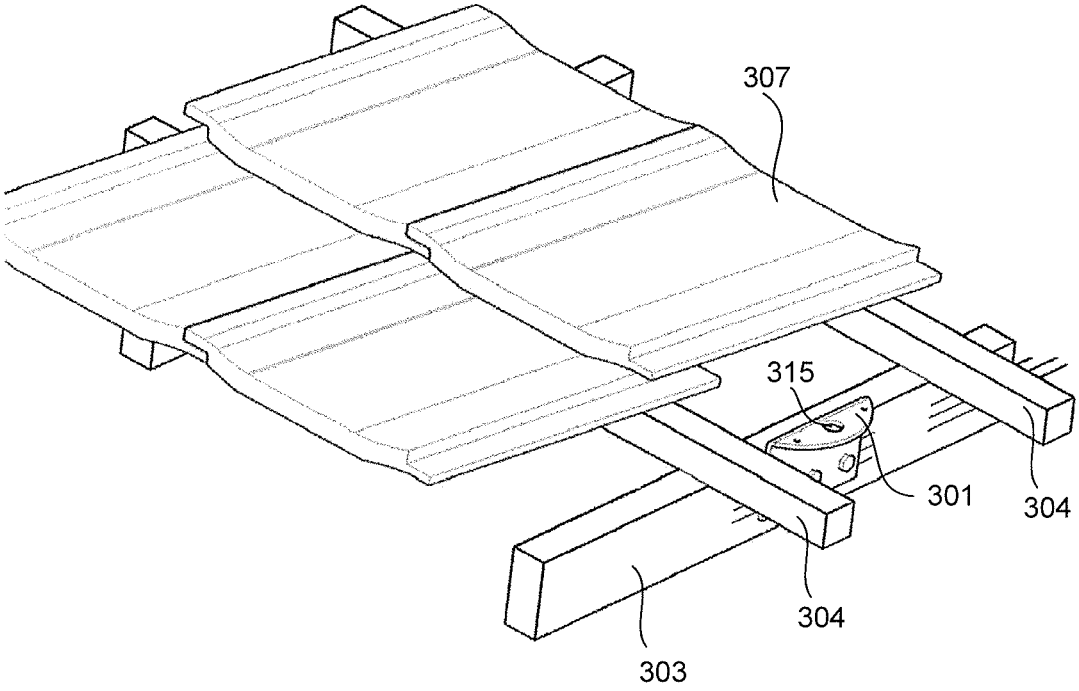
FIG. 18 illustrates a top view of a typical installation of a rafter anchor.
Figure 19:
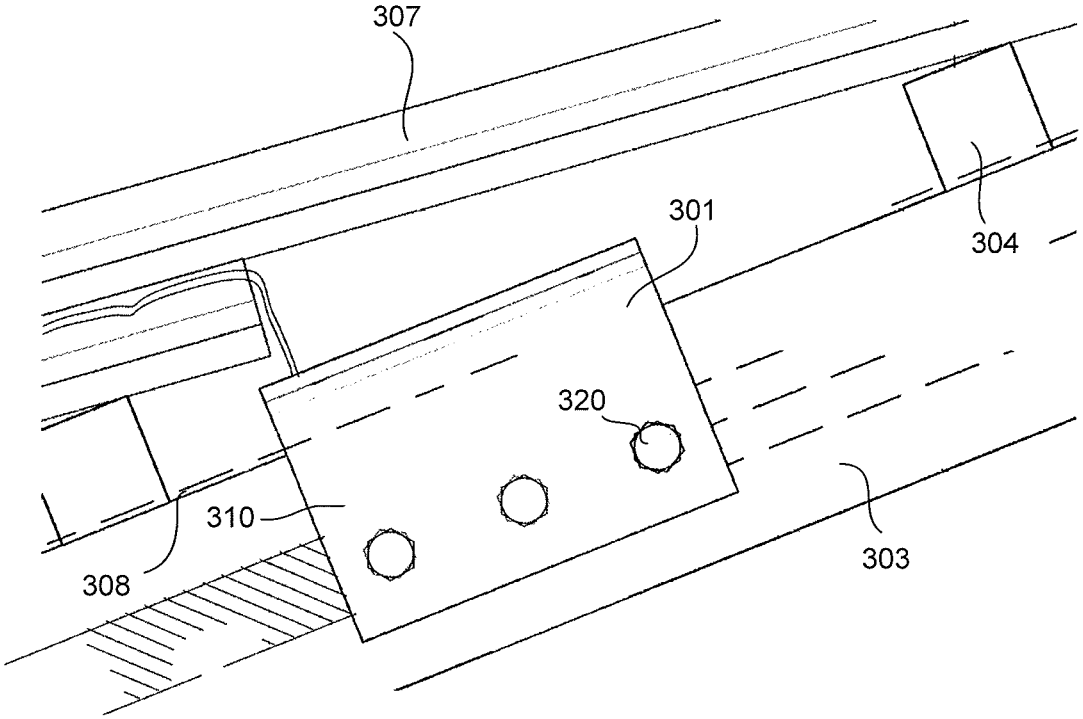
FIG. 19 illustrates a sectional view of a typical installation of a rafter anchor.
Figure 20:
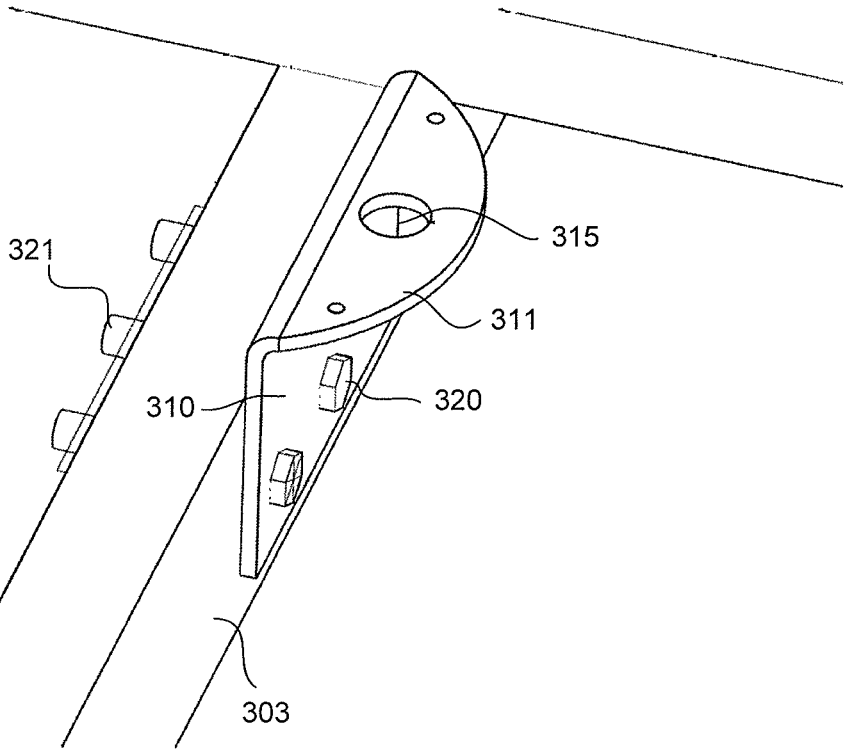
FIG. 20 illustrates a top view of a typical installation of a rafter anchor using nuts and bolts.

FIGS. 18, 19, and 20 illustrate a typical installation of a rafter anchor 301 under a tiled roof comprising a rafter 303 supporting a tile batten 304, tiles 307 arranged on top of the tile batten 304 and sarking 308 installed under the tile batten 308. The rafter anchor 301 is located adjacent to the rafter 303 such that the base 310 of anchor 301 abuts the vertical side of the rafter 303 and the flange 311 is on top and points away from the rafter. The rafter anchor 301 is secured to the rafter 303 by bolts 320 and nuts 321. The sarking 308 provides protection against water entering through the roof and also provides insulation.

Figure 21:
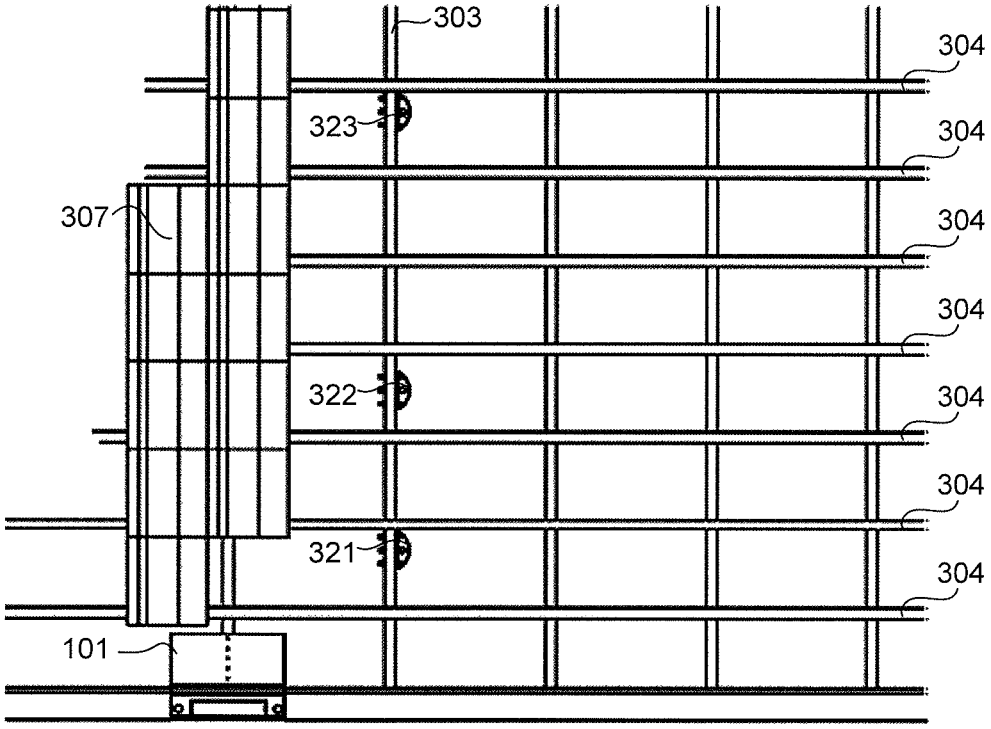
FIG. 21 illustrates a typical setup of multiple rafter anchors.

FIG. 21 illustrates a typical setup of multiple rafter anchors 321-223 installed in a tiled roof on one rafter 303. The figure also shows a gutter ladder anchor 101. A worker accesses the roof by attaching a ladder to the ladder anchor 101 and climbing up the ladder to reach the top of the roof. Depending on where the worker needs to perform work to the roof, the worker chooses the most appropriate rafter anchor to attach the safety line. In one example, the worker needs to work on the topmost batten and therefore attaches the safety line to rafter anchor 323. Because anchor 323 is also the highest anchor, the length of the safety line can be longer than using lower anchors 321 or 322. As a result, the worker has a wider range of movement with being safely secured against falling off the roof.

For installing the rafter anchor 301, the tiles are removed where the anchor is needed to expose the rafter/truss. If sarking is in place (not shown in the figures), a hole is cut in the sarking to expose the rafter/truss. If the sarking is in place, the top of the anchor needs to rise above the sarking but not too high as to effect this. Holes are drilled in the rafter/truss. Bolts, nuts and washers are used to attach the anchor to the rafter/truss. Then the installation is repaired and the anchor is ready for use. Finally, a ribbon is attached to the ribbon hole 318 of the anchor 301 to locate the anchor when tiles are replaced.

In case the roof is supported by steel trusses instead of timber rafters, the anchor needs to have a different shape. Most steel trusses do not have a plane vertical side face but a plane top face. Therefore, a truss anchor needs to be installed on the top face of a steel truss.

Figure 22:
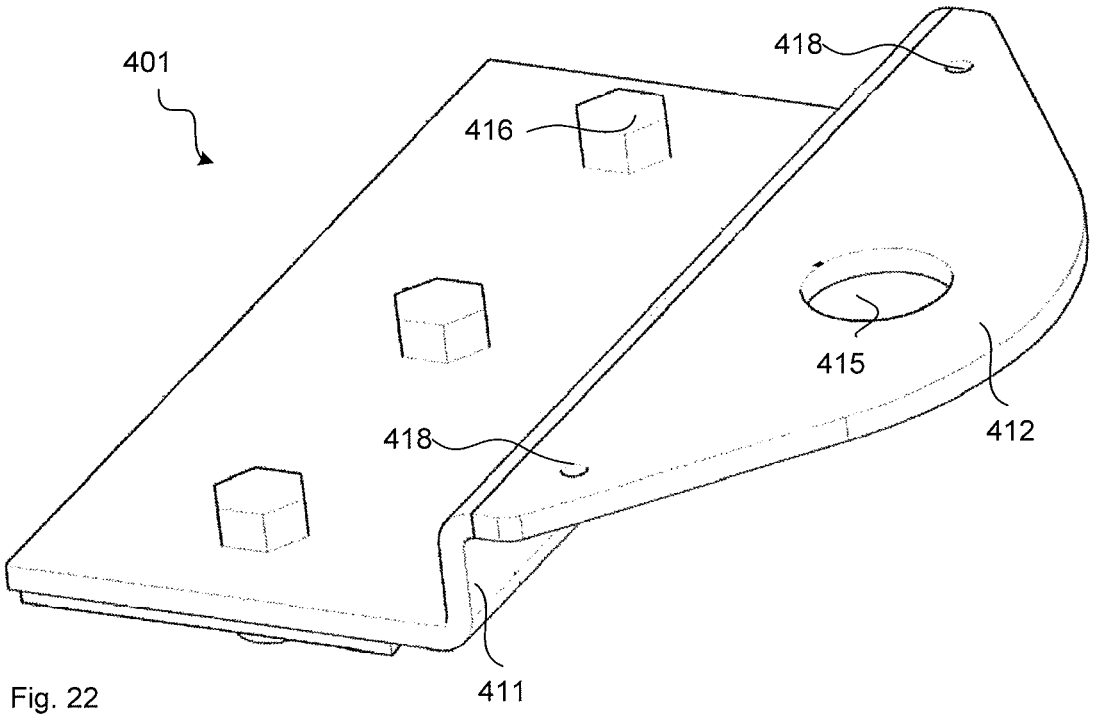
FIG. 22 illustrates a truss anchor.

FIG. 22 illustrates a truss anchor 401. The truss anchor 401 is formed of a steel plate including a base 410, having a front end, a web 411 upwardly extending from the front end, and a rounded extension 421. The web 410 connects the base 410 and the rounded extension 421. A safety line hole 415 is centred in the rounded extension 421 and three mounting holes 416 are located in the base 410 for fixing the truss anchor to the top face of a steel truss. The holes can vary in size depending on the type of sheeting used for each of the anchor points. Two ribbon holes 418 are located in the upper leg for attaching ribbons to locate the anchor when the tiles are replaced.

In use, the base 410 is fixed to a truss using bolts inserted in mounting holes 416 and provides support for the web 411 and the rounded extension 412. A safety line is attached to safety line hole 415 to secure a worker from falling off the roof.

Figure 23:
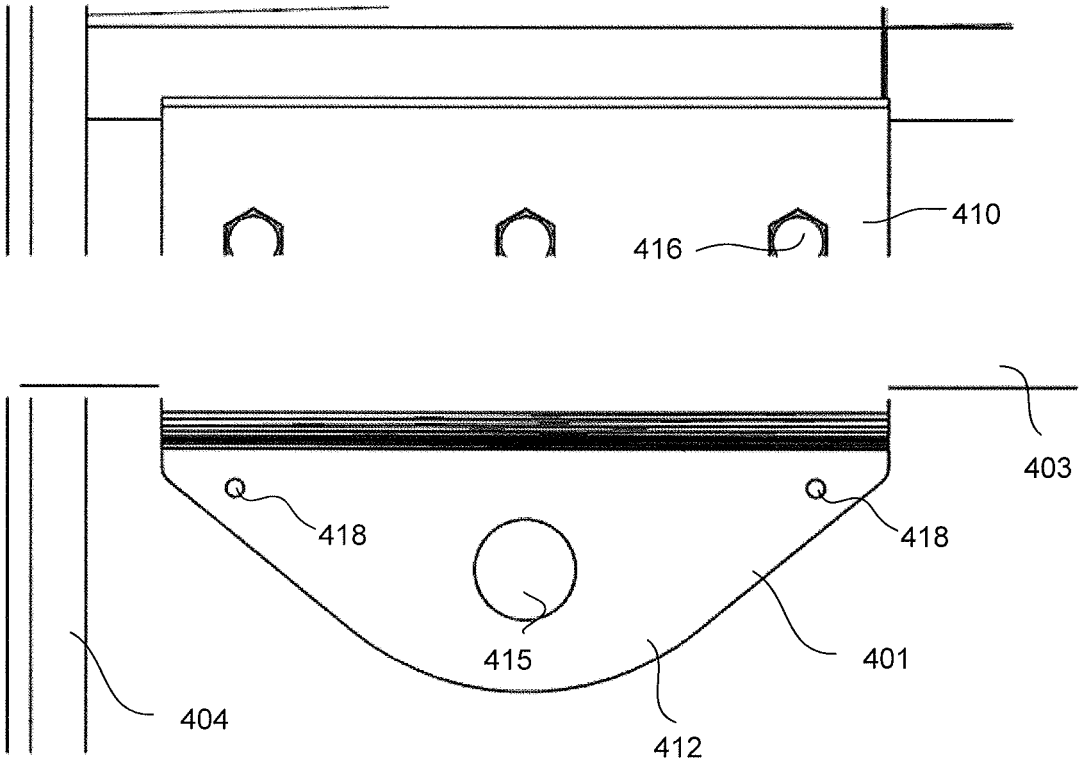
FIG. 23 shows a top view of a typical installation of a truss anchor.
Figure 24:
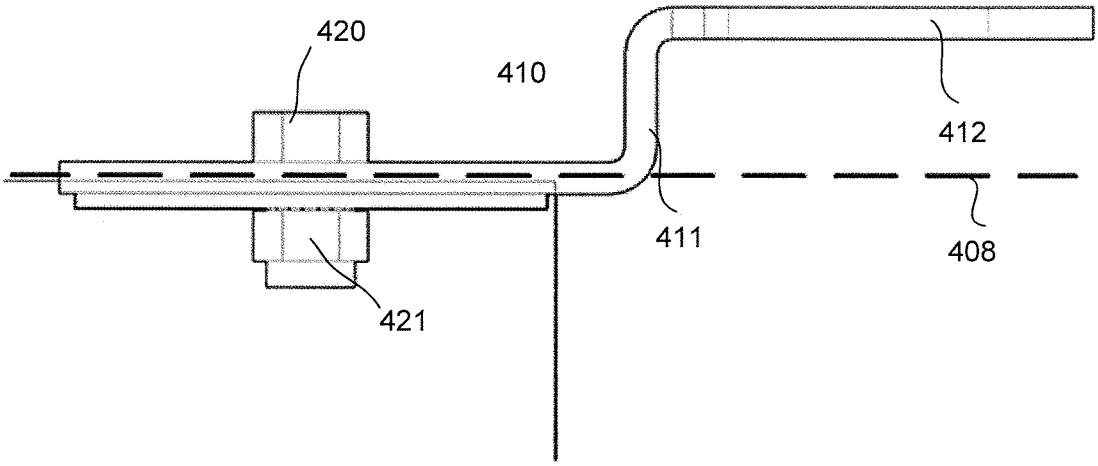
FIG. 24 shows a sectional view of a typical installation of a truss anchor.

FIGS. 23 and 24 show a top view and sectional view respectively of a typical installation of a truss anchor 401 on a steel truss 403, which supports a batten 404 and sarking 408. The truss anchor is placed on the top face of the steel truss such that the base 410 is aligned with the truss 403 and the rounded extension 412 protrudes from the truss 403 upwardly. As a result, the rounded extension 412, the safety line hole 415, and the ribbon holes 418 lie above the sarking 408. The truss anchor 401 is secured to the truss by bolts 420 and nuts 421.

Figure 25:
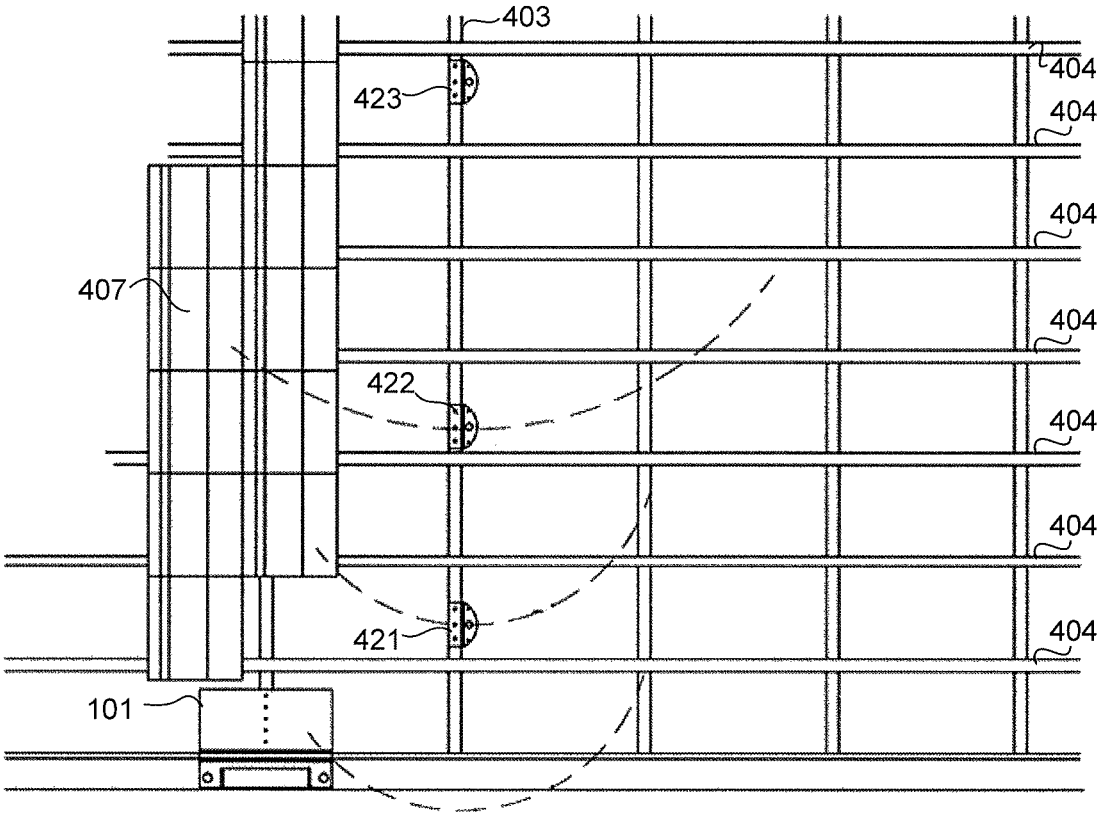
FIG. 25 illustrates a typical setup of multiple truss anchors

FIG. 25 illustrates a typical setup of multiple truss anchors 421-423 installed in a tiled roof on one truss 403. The figure also shows a gutter ladder anchor 101. A worker accesses the roof by attaching a ladder to the ladder anchor 101 and climbing up the ladder to reach the top of the roof. Depending on where the worker needs to perform work to the roof, the worker chooses the most appropriate truss anchor to attach the safety line. In one example, the worker needs to work on the topmost batten and therefore attaches the safety line to truss anchor 423. Because anchor 423 is also the highest anchor, the length of the safety line can be longer than using lower anchors 421 or 422. As a result, the worker has a wider range of movement with being safely secured against falling off the roof.

The installation of a truss anchors is similar to the installation of a rafter anchor with the difference, that the holes in the truss are drilled vertically instead of drilling horizontally through the rafter.

The benefit of the described rafter and truss anchors is that they can be installed almost any where on the roof with minimal cost.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. A method of providing an anchor point on a roof for securing a worker, the roof comprising sheeting material and structural members supporting the sheeting material, said method comprising:

providing a roof anchor formed from a plate bent into a U-shape to define a first leg and a second leg, the legs being substantially parallel are interconnected by a web defining a slot for sliding engagement over the roof sheeting material, the first leg terminating in a first end and the second leg terminating in a second end, at least one anchor point for securing a worker at the first end;

installing the second leg of the roof anchor under the roof sheeting material by sliding the roof anchor relative to the roof sheeting material so that the roof sheeting material slidably engages the slot; and securing the second leg relative to the structural members of the roof, wherein, when the second leg is installed under the roof sheeting material, the first leg is above the roof sheeting material exposing the anchor point.

2. The method of claim 1, comprising:

providing a first pattern of spaced apart holes through the first end of the roof anchor;

providing a second pattern of spaced apart holes through the second end of the roof anchor, the holes of said second pattern being aligned with the holes of the first pattern; and installing fasteners through corresponding holes in the first and second pattern to secure the anchor to a structural member located under the roof sheeting material.

3. The method of claim 2, wherein the roof sheeting material is corrugated.

4. The method of claim 3, wherein the holes of the first and second patterns comprise holes that are spaced to align with crests in the roof sheeting material.

5. The method of claim 2, comprising installing flashing over an intersection between the first leg of the anchor and the roof sheeting material.

6. The method of claim 5, wherein the flashing is ridge capping.

7. The method of claim 1, comprising attaching an accessory to the anchor point, the accessory being selected from the group consisting of: a safety line anchor bolt and a safety line.

8. The method of claim 1, wherein the roof anchor comprising:

a first end and a second end defining a longitudinal axis therebetween, wherein at least one anchor point is provided in the first end for attaching an accessory thereto for securing a worker.

9. The method of claim 8, wherein the roof anchor comprising, a U-shaped plate having a first leg defining the first end, a second leg defining the second end, a web extending between the first and second legs, and an open end at an opposite end of the legs from the web for sliding engagement over the roof sheeting material;

a first pattern of spaced apart holes through the first leg; and a second pattern of spaced apart holes through the second leg, the holes of said second pattern being aligned with the holes of the first pattern, such that, in use, fasteners can be installed through corresponding holes in the first and second pattern to secure the anchor to a structural member located under the roof sheeting material.

10. The method of claim 9, wherein the holes of the first and second patterns of the roof anchor comprise holes that are spaced to align with crests in the roof sheeting material.

11. The method of claim 8, wherein the roof anchor comprising at least two anchor points in the first end, the anchor points being spaced apart in a direction orthogonal to the longitudinal axis.

12. The method of claim 11, wherein the roof anchor comprising a pair of ladder locator brackets, each connected to a respective one of the anchor points, the ladder locator brackets extending outwardly from guttering of the roof to limit sideways movement of a ladder placed therebetween.

13. The method of claim 1, comprising installing the roof anchor at a ridge of the roof.

* * * * *